US009142084B2

(12) United States Patent
Kelly et al.

(10) Patent No.: US 9,142,084 B2
(45) Date of Patent: Sep. 22, 2015

(54) WAGER RECOGNITION SYSTEM

(75) Inventors: James V. Kelly, Las Vegas, NV (US); Troy D. Nelson, Big Lake, MN (US); Vladislav Zvercov, Las Vegas, NV (US); Attila Grauzer, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 123 days.

(21) Appl. No.: 12/946,814

(22) Filed: Nov. 15, 2010

(65) Prior Publication Data

US 2012/0122559 A1 May 17, 2012

(51) Int. Cl.

| | |
|---|---|
| ***A63F 3/00*** | (2006.01) |
| ***A63F 9/24*** | (2006.01) |
| ***G07F 17/32*** | (2006.01) |

(52) U.S. Cl.

CPC ..... *G07F 17/322* (2013.01); *A63F 2003/00662* (2013.01); *A63F 2009/2419* (2013.01); *A63F 2009/2425* (2013.01); *G07F 17/32* (2013.01); *G07F 17/3232* (2013.01); *G07F 17/3239* (2013.01); *G07F 17/3251* (2013.01); *Y10T 29/49826* (2015.01)

(58) Field of Classification Search

CPC ..... A63F 9/24; A63F 2009/2419; A63F 2009/242; A63F 2009/2422; A63F 2009/2425; A63F 2003/00662; G07F 17/32; G07F 17/3239; G07F 17/3232; G07F 17/322; G07F 17/3251

USPC ..... 463/25

See application file for complete search history.

(56) References Cited

U.S. PATENT DOCUMENTS

| | | | |
|---|---|---|---|
| 3,939,953 | A | 2/1976 | Miyazawa |
| 4,305,586 | A | 12/1981 | Richards |
| 4,488,431 | A | 12/1984 | Miga |
| 4,593,904 | A | 6/1986 | Graves |
| 4,651,997 | A | 3/1987 | Wood |
| 4,652,998 | A | 3/1987 | Koza et al. |
| 4,659,087 | A | 4/1987 | Shen et al. |
| 4,743,022 | A | 5/1988 | Wood |
| 4,756,531 | A | 7/1988 | DiRe et al. |
| 4,813,675 | A | 3/1989 | Greenwood |
| 4,836,546 | A | 6/1989 | DiRe et al. |
| 4,836,553 | A | 6/1989 | Suttle et al. |
| 4,837,728 | A | 6/1989 | Barrie et al. |
| 4,842,276 | A | 6/1989 | Darby |
| 4,861,041 | A | 8/1989 | Jones et al. |
| 4,882,473 | A | 11/1989 | Bergeron et al. |
| 4,906,005 | A | 3/1990 | Manabe |
| 4,948,134 | A | 8/1990 | Suttle et al. |
| 5,019,973 | A | 5/1991 | Wilcox et al. |

(Continued)

FOREIGN PATENT DOCUMENTS

| | | |
|---|---|---|
| CA | 2195329 | 10/1995 |
| DE | 4439502 | 1/1995 |
| EP | 0443420 | 9/1995 |

*Primary Examiner* — Werner Garner
(74) *Attorney, Agent, or Firm* — TraskBritt

(57) ABSTRACT

A gaming table apparatus has a gaming table with a gaming table support surface. At least two token sensors are provided, which are electrically connected in series to a token sensor controller. The at least two token sensor units are physically restrained by the table support surface. The game controller is in communication with the token sensor controller, wherein the game controller is configured to associate player position data with transmitted wager data received from the token sensor controller.

25 Claims, 12 Drawing Sheets

(56) References Cited

U.S. PATENT DOCUMENTS

| | | | | |
|---|---|---|---|---|
| 5,042,635 | A | 8/1991 | Bell | |
| 5,042,818 | A | 8/1991 | Weingardt | |
| 5,078,405 | A | 1/1992 | Jones et al. | |
| 5,098,107 | A | 3/1992 | Boylan et al. | |
| 5,112,060 | A | 5/1992 | Jones | |
| 5,114,155 | A | 5/1992 | Tillery et al. | |
| 5,116,055 | A | 5/1992 | Tracy | |
| 5,167,413 | A | 12/1992 | Fulton | |
| 5,248,142 | A | 9/1993 | Breeding | |
| 5,275,400 | A | 1/1994 | Weingardt et al. | |
| 5,275,415 | A | 1/1994 | Wisted | |
| 5,288,077 | A | 2/1994 | Jones | |
| 5,288,081 | A | 2/1994 | Breeding | |
| 5,364,104 | A | 11/1994 | Jones et al. | |
| 5,377,994 | A | 1/1995 | Jones | |
| 5,382,025 | A | 1/1995 | Sklansky et al. | |
| 5,393,067 | A | 2/1995 | Paulsen et al. | |
| 5,417,430 | A | 5/1995 | Breeding | |
| 5,472,194 | A | 12/1995 | Breeding et al. | |
| 5,544,892 | A | 8/1996 | Breeding | |
| 5,735,742 | A | 4/1998 | French | |
| 5,794,964 | A | 8/1998 | Jones et al. | |
| 5,836,583 | A | 11/1998 | Towers | |
| 5,909,876 | A | 6/1999 | Brown | |
| 5,924,926 | A | 7/1999 | Brown | |
| 6,299,534 | B1 | 10/2001 | Breeding et al. | |
| 6,446,864 | B1 | 9/2002 | Kim et al. | |
| 6,596,407 | B2 | 7/2003 | Nishimura et al. | |
| 7,083,891 | B2 | 8/2006 | Shimomura et al. | |
| 7,367,884 | B2 | 5/2008 | Breeding et al. | |
| 7,407,438 | B2 | 8/2008 | Schubert et al. | |
| 7,462,444 | B2 | 12/2008 | Oka et al. | |
| 7,593,544 | B2 | 9/2009 | Downs, III et al. | |
| 7,645,489 | B2 | 1/2010 | Ozawa et al. | |
| 7,677,565 | B2 | 3/2010 | Grauzer et al. | |
| 7,717,427 | B2 | 5/2010 | Grauzer et al. | |
| 7,749,316 | B2 | 7/2010 | Mizushima et al. | |
| 7,764,836 | B2 | 7/2010 | Downs, III et al. | |
| 7,766,332 | B2 | 8/2010 | Grauzer et al. | |
| 7,769,232 | B2 | 8/2010 | Downs, III | |
| 2004/0009799 | A1* | 1/2004 | Breeding et al. | 463/11 |
| 2004/0204240 | A1* | 10/2004 | Barney | 463/36 |
| 2007/0017983 | A1* | 1/2007 | Frank et al. | 235/385 |
| 2008/0303210 | A1 | 12/2008 | Grauzer et al. | |
| 2010/0093429 | A1* | 4/2010 | Mattice et al. | 463/25 |
| 2011/0115157 | A1* | 5/2011 | Filo et al. | 273/237 |
| 2011/0309578 | A1* | 12/2011 | Lambert et al. | 273/274 |

* cited by examiner

WAGER RECOGNITION SYSTEM

TECHNICAL FIELD

The present invention relates to the field of table gaming, wagering methods and apparatus on gaming tables, and automated recognition of wagers on gaming tables.

BACKGROUND

In casino table games, wagering was originally done (and in many circumstances is still done) exclusively by the physical placement of money, currency, coins, tokens or chips on the gaming table and allowing the wager to remain on the gaming table until conclusion of the game and resolution of the wager(s). The placement of physical wagers on tables allows for some players to attempt to commit fraud on casinos by late placement of wagers, alteration of wagers and particularly placement of side bet wagers, bonus wagers and jackpot wagers.

Side bets, bonus and jackpot payouts can reach levels of hundreds of thousands of dollars at gaming tables and the temptation to commit fraud at a table increases. Similarly, the casinos need to prevent fraud increases to assure the game is fair to players. With the linkage of games (e.g., different games) within a casino or among different casinos, a uniform standard of control is needed that assures equal avoidance and prevention of cheating at all tables and at all facilities.

In the past twenty years, numerous systems have been provided or disclosed for the automated recognition of wagers, including side bet, bonus and jackpot wagers. Among the disclosures of these types of technologies include U.S. Pat. No. 5,794,964 (Jones) in which a sensor detects when a gaming token is dropped into a slot on the gaming table and a coin acceptor is mounted to detect the passage of a gaming token through the slot.

U.S. Pat. Nos. 5,544,892, 6,299,534 and 7,367,884 (Breeding) discloses an apparatus for detecting the presence of a gaming token. This apparatus has at least one predetermined location for receiving a gaming token on a gaming table. At each predetermined location for receiving a gaming token designated on the gaming table, a proximity sensor is mounted to the gaming table such that each sensor is aligned with one predetermined location. A decoder is electrically connected to each proximity sensor for determining whether a gaming token is present at each predetermined location. When the presence of a gaming token is sensed by the decoder, the player's bet is registered by transmission of the sensed presence to a processor. Each sensor in these systems has a parallel connection to a processor (e.g., game processor or system processor) where the individual wagers are recorded and identified. In a preferred embodiment, there is a backlight under the predetermined location that lights up when a wager is made at that location, and remains lit when the processor identifies acceptance and recognition of the wager during each game or round of play at the gaming table.

Systems with parallel connections between wager sensors and processors are still believed by applicants to be susceptible to individual manipulation, at each wagering position and are difficult to install. There are also limits on the number of sensors that may be connected in parallel to the processor. Additional forms of technology are believed necessary to increase security in casino table wagering games, and to make installation easier and faster to accomplish.

DISCLOSURE

A gaming table is provided with an integrated wager detecting system. The wager detecting system is installed on a rigid table support surface. Electrical components are arranged above the support surface and are mounted into a cushioning layer above the support surface. Multiple token sensors are mounted into enclosures or holes in a cushioning layer on the game table. The enclosures for the token sensors are mounted on the support surface and also located within the cushioning layer. Within each of the enclosures is an optical sensor that is electrically connected (in communication) in series to a token sensor controller, which controller may also be a processor having additional functions on the gaming table. Grounding wires and electrical wires connecting the sensors to the token sensor controller are mounted within the cushioning layer. The token sensor controller is in electrical and communication connection with a separate game controller, preferably located in or proximate a dealer input terminal. The token sensor controller transmits and receives signals from the game controller in a two-way communication link. The game controller provides instructions to the token sensor controller, such as instructions to begin a new game. Upon receiving this instruction, the token sensor controller determines a presence of any particular wager, especially a side bet wager, optional or mandatory bonus wager and the like, such as a progressive wager. Each token sensor (also known as a coin spot) with associated electronics is mounted beneath or within an aperture in an electronic circuit board suspended in or otherwise mounted in the enclosure. The upper surface of the board has a plurality of light radiation emitters (e.g., visible light, IR radiation, and/or UV radiation) positioned in a manner such that only reflected light (light reflected from wagering elements) is received by a light radiation receiver (LRR) within the token sensor. The LRR is positioned beneath an aperture in the electronic circuit board. The multiple emitters, the position of the emitters relative to the aperture, the optical characteristics of the emitter and the position of the LRR relative to the aperture assures that a presence of all wagering elements, including dark colored chips will be accurately sensed.

DETAILED DESCRIPTION

Figure 1:
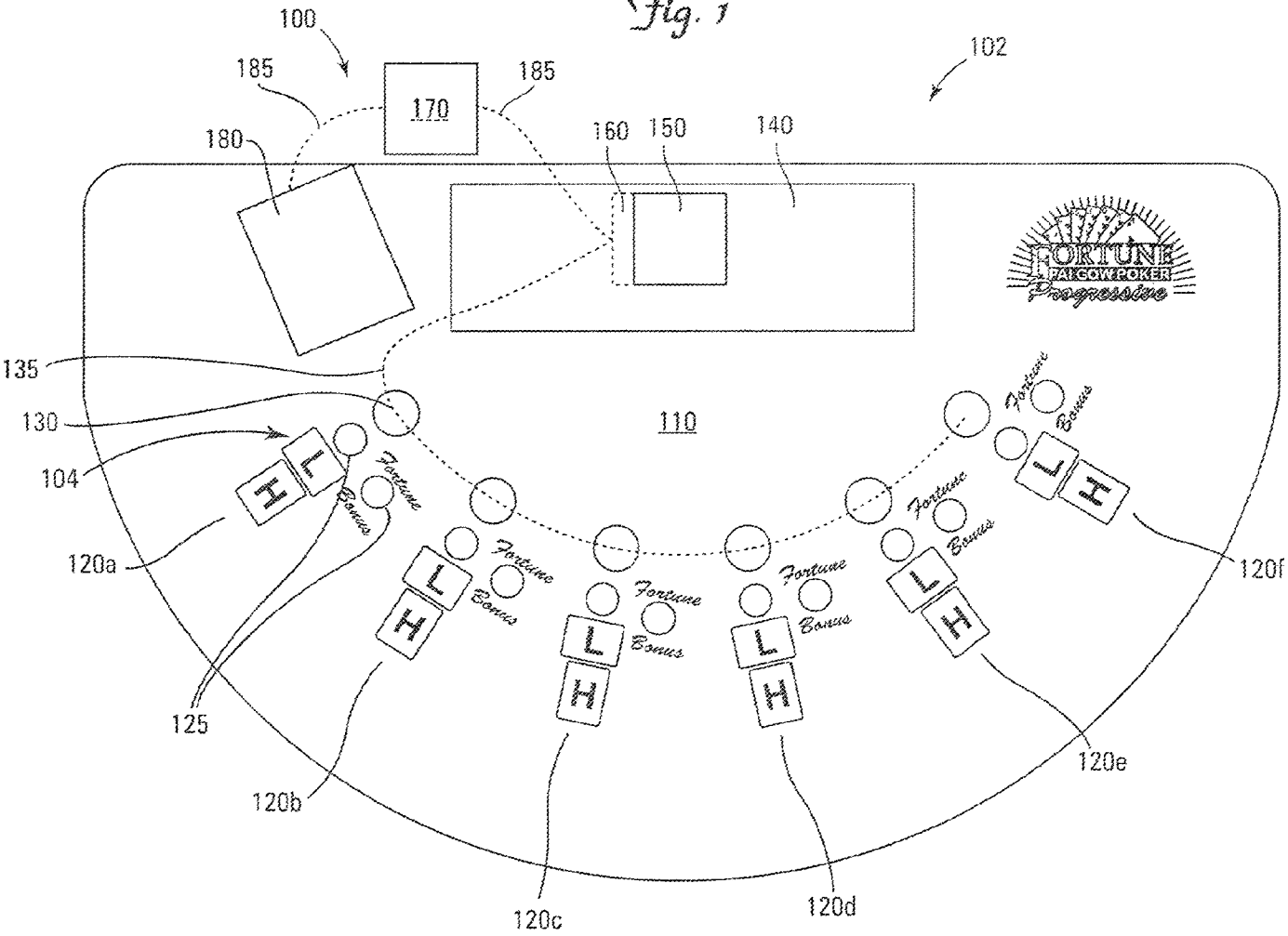
FIG. 1 is a top plan view of an exemplary gaming table apparatus with an integrated wager sensing system.

The present technology may be described as including a gaming table apparatus that has at least: a gaming table support surface; a token sensor controller; at least two token sensor assemblies that are electrically connected in series to the token sensor controller; the at least two token sensor assemblies physically restrained by the table support surface; and a game controller in communication with the token sensor controller, wherein the game controller is configured to associate player position data with transmitted wager data received from the token sensor controller. It is to be understood that the token sensor assembly includes electrical components, such as a circuit board with a memory component, connectors, sensing devices, light emitters, and the like. Also included in the assemblies is a tubular side wall structure, a base that may be mounted by conventional means such as wood screws to a gaming table surface, a removable lens cover and optionally a diffuser. The diffuser is positioned above the circuit board within the token sensor assembly and beneath the lens cover. The diffuser hides the circuitry from view and provides a desirable visual effect when red lights are activated to indicate to the house (or players) that a wager is active.

It is to be understood that the "assembly" is referred to in various parts of this disclosure to include or exclude the protective lens cover and diffuser.

The token sensor may data may be interpreted to determine the player positions with live wagers. The apparatus may have a gaming table support surface with a flexible material (or a cushioning material) having electrical wires therein which provide a serial communication link between the at least two sensors and the token sensor controller. For example, the flexible material is selected from the group consisting of a) felt, b) elastomeric polymer, c) polymeric foam and combinations of a), b) and c). In one embodiment, each token sensor unit may be a module that engages into a serial communication link with a first contact on each token sensor. A second contact is also provided on each token sensor assembly that engages a power source. Engaging may be effected by a quick-connect connection, screw-in connection or gripping, toggled connection or any other known electrical connection between the contacts and wiring in the apparatus.

One aspect of the present technology may be alternatively described as a token sensor for a wagering system that has: a container having a height and side walls which define an inside and outside perimeter of the container, and a top surface and bottom surface of the container. A light transmitting cover is disposed on the top surface of the side walls of the container. A circuit board having a top side, a bottom side and an aperture disposed through both the top side and bottom side is provided. The circuit board is secured to the inside perimeter of the container.

A plurality of token-sensing light sources is positioned on the top side of the circuit board above the aperture. At least one light sensor is disposed on the bottom side of the circuit board beneath the aperture, wherein the plurality of token-sensing light sources enable the at least one light sensor to sense light reflected off chips positioned on the light transmitting (translucent or transparent) lens cover having a reflective optical density of white light at least equal to 1.5 units. Measurement of reflective optical density is well established in the imaging art and commercial densitometers (e.g., MacBeth brand) can be used to take these measurements.

Optical density is a standard measurement used in the field of imaging and is well known in the art both for transmission and reflectance optical density (the latter being used herein). Examples of the methodology and measurement of optical density (e.g., with a MacBeth densitometer is well described in the literature, such as in U.S. Pat. Nos. 7,749,316; 7,645,489; 7,462,444; 7,083,891; and 6,596,407. Transmission optical density measures the amount of light absorbed when passing through a film, and reflectance optical density measures the amount of light (generally or at a specific wavelength) that is reflected off a surface. These cited patents are incorporated by reference in their entirety to discuss and enable concepts of optical density. Optical density is measured in optical density units, usually with a total range of 0.0 to about 5.0.

To effect optimal results, the plurality of token sensing light sources emit over a narrow range of wavelengths and the light sensor is optimized to receive and sense that narrow range of wavelengths. In addition, the light transmitting lens cover in preferred embodiments has significant light transmission ability over or within the narrow range of wavelengths emitted and sensed. For example, the narrow range could be from 680 nm to 750 nm in wavelength, covering much of the red visible range of the electromagnetic spectrum. If a monochromatic light source was used (e.g., an LED emitting at 730 nm), the sensor could be tuned to sense most efficiently at that wavelength, and the light transmitting cover would appear red to the naked eye, transmitting visible radiation efficiently at 730 nm. A translucent cover is preferred to avoid any harsh, bright light passing through the cover around edges of a token or after a token has been removed, which harsh light might annoy players at the gaming table. The light-transmitting cover may be any light-transmitting material, such as glass or polymer, and especially polymeric materials which can be molded, formed and machined, such as polyesters (e.g., LEXAN® polyester), polycarbonates, polyolefins (especially polypropylene, polyethylene and mixtures thereof), thermoplastic polymers and cross-linked polymers. The color in the light-transmitting cover may be provided by dyes or pigments of the desired wavelengths. Red is a color that has been used frequently on electronic wagering areas in the gaming industry. Embossing, engraving, etching and printing on the light-transmitting cover may be used to add translucency and alphanumeric information. Translucency may also be provided by light-scattering particulates or bubbles in the composition of the cover.

The light transmitting cover is preferably removable from the top surface of the side walls without having to remove the token sensor or container from the gaming table. In this manner, the light transmitting covers may be tailored for individual types of wagers and individual colors by replacement of the light-transmitting covers. For example, the light transmitting cover may be removable by snapping off the translucent cover by hand or with a tool, unscrewing the translucent cover or releasing a mechanical grip or lock on the cover.

Within the token sensor, the light sources preferably are located at a preselected distance (which can be readily calculated by simple geometry measuring reflectance angles of emitted light against the token and back towards the aperture in the token sensor) from the aperture such that light of sufficient intensity in wavelengths sensed by the sensors that is received by the sensors is transmitted through the translucent cover, reflected off of a token placed on the removable translucent cover and transmitted back through the translucent cover as the light passes back through the aperture to the sensor or sensors. The light emitters or light sources may be any electrically stimulated light-emitting device such as bulbs, LEDs, lasers and the like. It is preferred that the light sources have a narrow (less than 100 nm) range of emitted visible light, and preferable have a range of emitted light that is less than 50 nm, preferably less than 25 nm and most preferably less than 10 nm in range of wavelengths.

It is preferable to provide at least three light sources at a preselected distance from the aperture. The redundancy assures accurate chip detection even when chips are dark in color (i.e., black or navy blue). Prior art chip detection systems sometimes misread dark colored chips and interpret the results inaccurately. Redundant systems such as the emitters of the present invention reliably sense the presence of chips, even when the chip is predominantly dark in color. Redundant light systems of the present invention are more likely to sense a light spot on a chip that is predominantly dark in color than in systems having a single light sensing source.

Another preferred feature useful in the practice of the present technology is the structure of the container for retaining the token sensor. The outside perimeter of the container has at least two openings to allow electrical connection between internal components and exterior devices. One of the electric contacts is configured to engage a power source to power the token sensor for light emission and signal sending. The other contact is configured to engage a communication link to transmit signals from the sensor to a receiver outside of the container.

The gaming table apparatus with an integrated wagering system may be made in a number of ways. One general process for manufacture includes the steps of: placing at least two cushioning layers on a gaming table support surface; providing multiple openings in the two cushioning layers; providing channels in at least one of the cushioning layers and providing wiring within the channels; installing token sensors through the multiple openings in the at least one cushioning layer and onto a gaming table support surface; and engaging a signal transmitting output contact extending through an exterior surface of the token sensor with the wiring in the channel of the at least one cushioning layer.

The method preferably uses the token sensor assembly described above, such assembly having: a container having a height and side walls, which define an inside and outside perimeter, and a top surface and bottom surface; a translucent cover disposed on the top surface of the side walls; a circuit board having a top side, a bottom side and an aperture disposed through both the top side and bottom side, wherein the circuit board is secured to the inside perimeter of the container; and a plurality of light sources disposed on the top side of the circuit board above the aperture and at least one light sensor disposed on the bottom side of the circuit board beneath the aperture, wherein the plurality of light sources enable the at least one light sensor to sense light reflected off of a chip positioned on the translucent cover. Light sources useful in such an assembly have a reflective optical density of white light of at least 1.5.

In the method, the multiple openings could be provided in the at least one cushioning layer by placing a template over the at least one cushioning layer, wherein the template defines desired locations for at least a plurality of token sensors on the gaming table support surface. The method further includes the step of cutting a plurality of recesses in the at least one cushioning layer corresponding to the desired locations on the gaming table support surface to allow insertion of at least a plurality of token sensor assemblies.

The one or more channels may be cut in a top surface of the at least one cushioning layer for accepting wiring associated with the at least a plurality of token sensors. Wiring may be provided into the one or more channels cut in the top surface of the at least one cushioning layer. At least two token sensor assemblies may be installed into the corresponding plurality of recesses and associated with the wiring provided into the one or more channels. A second cushioning layer may be placed over the at least one cushioning layer, wherein the second cushioning layer may have a plurality of recesses corresponding to the locations of the plurality of token sensors. A gaming table layout is usually installed on top of the second cushioning layer, wherein the gaming table layout has a plurality of second openings cut into the layout at locations corresponding to locations of the plurality of token sensors. Preferably a grounding strap is provided that is in contact with each token sensor assembly side wall. The grounding strap is connected to an earth ground connection on the power source and can be installed either beneath the at least one cushion layer or in a channel cut in the cushion layer. The layout may also be stretched over the cushioned table surface and openings cut to accommodate the token sensor assemblies. After the gaming table layout has been installed on top of the second cushioning layer, a plurality of removable translucent covers may be secured onto the corresponding token sensor assemblies.

The present system can include multiple tables with each dealer terminal connected to server such as the commercially available GAME MANAGER™ system sold by Shuffle Master, Inc. This system may be used to link progressive proprietary table games such as the CARIBBEAN STUD® poker game, the THREE CARD POKER PROGRESSIVE® poker game, or the PROGRESSIVE TEXAS HOLD'EM™ poker game. Examples of systems which link multiple table games with coin sensors are disclosed in U.S. Pat. No. 5,393,067 and U.S. Pat. No. 4,861,041.

The sensors in prior art reference U.S. Pat. No. 7,367,884, used a modulated light sensor mounted into a machined enclosure or flanged "can," which, in turn, is flush-mounted into the gaming table surface. The sensor detects an object, or chip, placed on top of a lens above the sensor. When the light source in those sensors hits a "black spot" on the chip (a high optical density dark spot, such as black marking), the chip presence may not be sensed. A misread could also result from light reflecting off the inside of the sensor cover, or in some cases even ambient light "bleeding through" the cover to the receiver. Additionally, the sensor "can" structure required that a table top be retrofitted by drilling out holes in the table support surface to accommodate the "can." Furthermore, each individual sensor described in the '884 patent is directly connected to a gaming controller, which requires individual complicated wiring leading to a time consuming installation. Each coin spot requires its own microcontroller with associated software. Such software requires additional regulatory approval in some jurisdictions. Cumbersome surge protection is also needed in such systems. In addition, sensor assemblies cannot be easily replaced or added to existing tables.

An apparatus for sensing wagering tokens on a gaming table surface is disclosed that provides unique benefits to the modern casino environment. The token sensing system that includes at least two serially connected token sensing assemblies may be mounted into a gaming table support surface without modifications to the support surface. At least one cushioning layer is provided above the support surface, retaining associated wiring. A top surface of each assembly is flush with or elevated slightly (e.g., less than 2 mm, preferably less than 1 mm) above or below the gaming table surface, including the cushioning layer or layers. Preferably, the cushioning layer is formed of two layers of foam sheeting, a lower layer having grooves cut therein to accommodate grounding wires and live wires that run between sensors. The cushioning layer may also include a top decorative "layout felt."

On one table, a plurality of wager sensors may be housed in low profile can structures the tops of which rest on the support surface and have upper lens covers that are approximately flush-mounted (±2 mm) into the upper surface of the cushioning layer or decorative cover. Multiple wager sensor assemblies preferably are connected in series to a token sensor controller. The token sensor controller may include a field-programmable gated array (commonly known as a FPGA) or application-specific integrated circuit (ASIC), power supply, and clock generator. The token sensor controller is in communication with the dealer terminal. The dealer terminal may be integrated into or in communication with a game controller. Each table with these components is networked to a server through the dealer terminal. Preferably, multiple tables are connected to the server in a local area network (LAN within one pit in a casino, within one casino, or between certain tables in a casino) or a wide area progressive (WAP progressive system linking tables between one or more casinos). The number of tables that can be connected could be as few as one up to over a hundred tables.

A preferred token sensing assembly includes a container structure that is preferably cylindrical and includes a centrally mounted circuit board. Preferably the circuit board is suspended centrally within the structure. The circuit board has a top side, a bottom side, and an aperture passing through the top and bottom sides. The circuit board is secured to the inside perimeter of the container and is preferably spaced from both a top and bottom edge. There are a plurality of light sources disposed on the top side of the circuit board and a light receiver (light sensor) disposed on the bottom side of the circuit board beneath the aperture, wherein the plurality of light sources are positioned a predetermined distance from the aperture which allow light reflected off of the token and passing through the removable translucent cover to pass through the aperture to the receiver.

The positioning of the receiver below the aperture reduces the possibility of false token-present readings. Alternate means of preventing false positive readings can also be used such as providing a filter placed between the light emitter and receiver which prevents all light except light received at an expected range of angles and/or wavelengths to be received and/or sensed.

Reference to the figures will further assist in an appreciation of the present technology. FIG. 1 is an exemplary gaming table 102 with a wager sensing system 100. Preferably the wager sensing system 100 senses jackpot wagers. Other examples of the invention sense primary bets, other types of side bets and combinations thereof. The wager sensing system 100 may be used for a progressive jackpot system such as the system disclosed in U.S. Pat. No. 5,794,964 (Jones) or in any other bonus or side bet feature system. According to the invention, the gaming table 102 has a gaming table surface 110, preferably a felt surface with indicia thereon identifying elements 104 of the game, such as wager positions and odds. A plurality of player positions 120*a*-120*f* is disposed on the gaming table 102. Since all player positions 120 are essentially the same, only position 120*a* will be described in detail. Each player position 120 includes wager areas 125 and a bonus bet area, which comprises a token sensor assembly 130, preferably a progressive wager sensor. Token sensor assemblies 130 are electrically connected in series with wiring 135, shown as a dotted line. While in this example a token sensor assembly 130 is used for sensing only a progressive wager, it is understood that token sensors could be used for any and all wager areas without deviating from the scope of the invention. The preferred embodiment will allow one token sensor assembly for each player position, which player positions will number six or seven on a standard gaming table for games like TEXAS HOLD 'EM BONUS® poker, THREE CARD POKER® and Pai Gow Poker.

Chip tray 140 is disposed opposite player positions 120. Preferably, chip tray 140 includes an integrated dealer input and display 150 which is part of the dealer terminal. Token sensor controller 160 may be disposed within the housing of the chip tray 140 or within a separate housing mounted under gaming table 102. In this example, token sensor controller 160, shown in phantom, is adjacent the integrated dealer input and display 150. Preferably, token sensor controller 160 includes an FPGA or ASIC, power supply and clock generator and any other desired functions added to enhance the performance of the sensor. The circuit board in each coin sensor assembly contains several simple logic gates but no software runs on the board. These logic gates determine if the assembly is reading or writing to the sensor controller 160. A memory device is also incorporated into the board that responds to a clock pulse from the clock generator. Token sensor controller 160 is electrically connected to token sensor assemblies 130 by serial wiring 135. The system further includes game controller 170 electrically connected to the integrated dealer input and display 150 and token sensor controller 160 by system wiring 185. Preferably, the system also includes card handling device 180, such as a shoe or a shuffler, which is also electrically connected to game controller 170 by system wiring 185. It is further preferred that the shoe or shuffler contain card reading functionality so that cards stored, delivered or withheld have at least one of suit and rank read and that information processed as desired, as disclosed for example in U.S. Pat. Nos. 7,769,232; 7,766,332; 7,764,836; 7,717,427; 7,677,565; 7,593,544; and 7,407,438.

Figure 2:
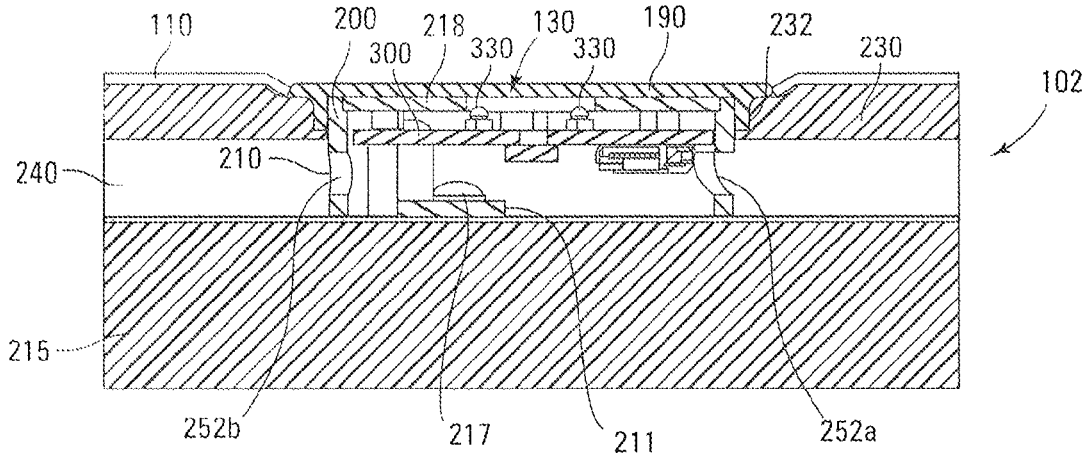
FIG. 2 is a side cross-sectional view of the exemplary token sensor assembly installed in the gaming table apparatus.

FIG. 2 is side cross-sectional view of token sensor assembly 130 installed in gaming table 102. Gaming table 102 includes gaming table support surface 215. In a typical gaming table 102, this gaming table support surface 215 comprises a layer of plywood or other rigid material. First cushioning layer 240, is preferably formed of foam sheeting, and is placed on gaming table support surface 215. A plurality of openings or holes 210 are cut into first cushioning layer 240 as well as at least one channel (not shown) is cut horizontal into the foam layer between holes 210. This channel is used to accommodate sensor wiring 135 and a grounding strap (not shown). The channels may be cut in a "V" shape, "U" shape, rectangular or square shape or any other shape to accommodate connecting wiring.

Whenever power is transmitted through flexible wiring, there is a possibility for interference. The use of a grounding strip is one method of preventing interference and/or reducing sensitivity to outside interference from electrical current flowing through wires (n power and communication). It has been found that using a lower frequency in the transmission of power further reduces such interference problems and in some very low frequency ranges (e.g., less than 500 Hz, e.g., 150-400 Hz or 200-350 Hz) the need for the grounding strip is reduced and interference issues are also reduced. It is possible to transfer data at low frequency ranges because the quantity of data being transferred is small. This, in turn, allows the use of a simple resistor/capacitor solution to passing a state discharge test.

Preferably, a second cushioning layer 230 is installed directly above first cushioning layer 240 and the second cushioning layer has aligning openings 232 corresponding to plurality of openings or holes 210. Preferably, the second cushioning layer 230 does not have corresponding channels as the absence of the second set of channels helps to smooth out the gaming table surface 110 or felt and conceal the wires.

Figure 3:
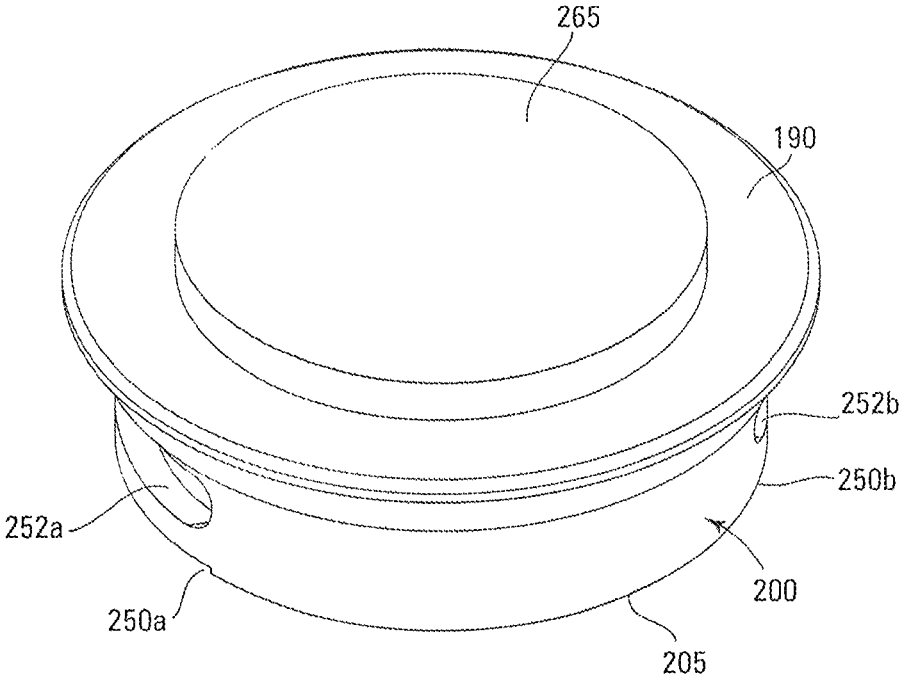
FIG. 3 is a top perspective view of an exemplary token sensor assembly, with wiring removed, and a token placed on the assembly.

Disposed within openings 210 are token sensor containers 200, or cylindrical cans. The token sensor containers 200 have side walls and an integrally formed base connector 211. The connector 211, in one example of the invention, provides an attachment means to secure the token sensor container 200 to the table support surface 215 by means of a wood screw 217 or other suitable securing device. Removable translucent covers 190 may "snap" or screw into or onto the top edge of token sensor container 200 and sit relatively flush (e.g., ±2.0 mm, ±1.0 mm or ±0.05 mm) with gaming table surface 110. Translucent cover 190 supports gaming tokens being sensed (not shown) and also may assist in securing felt 110 to the table surface. Also included in the assembly is a filter 218, which, in a preferred embodiment, is disc-shaped with an aperture large enough to allow the sensor lights to project light upwardly through a lens. The filter 218 provides a softer appearing light that is provided to indicate the presence of a wager to the player or to the house (lights 320 in FIG. 4), but do not provide a light source for actual wager sensing. As shown in FIG. 3, one or more wiring grooves 250*a*, 250*b* are disposed around the bottom end of token sensor container 200 and grounding strap to be connected to a token sensor located within the can structure.

A token 265 sits on removable translucent cover 190, which is disposed on the top end of token sensor container 200. Preferably, token sensor container 200 has a total height (without the cover) from about one-half inch to about five-eighths inch and nests within the cushioning layer or layers, making it unnecessary to cut holes into table support surface 215. This simplifies installation and maintenance and reduces the down time needed to convert a conventional table to a table equipped with automatic wager sensing apparatus. Disposed at the bottom end of token sensor container 200 is one or more wiring grooves 250*a* and 250*b*.

Figure 4:
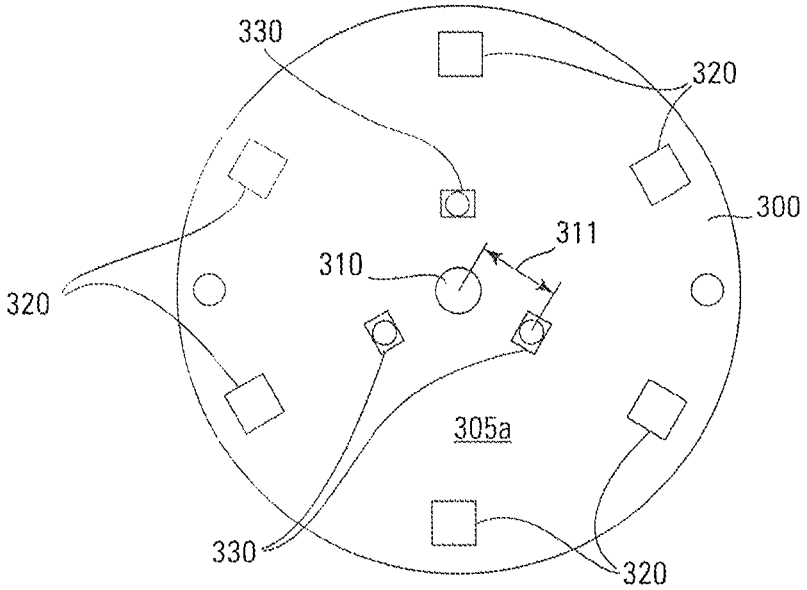
FIG. 4 is a top plan view of the exemplary token sensor circuit board.
Figure 5:
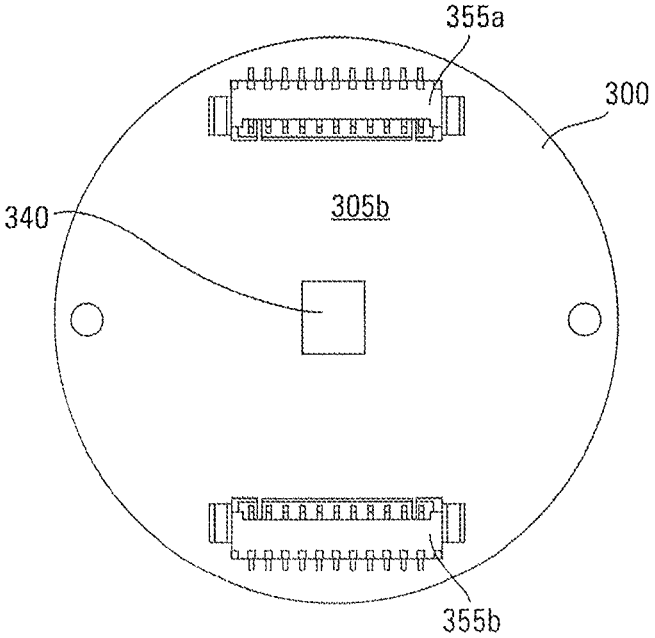
FIG. 5 is a bottom plan view of the exemplary token sensor circuit board.

Token sensor container 200 has side walls 205 that define an inside and outside perimeter of token sensor container 200. Secured to the inside perimeter of token sensor container 200 is circuit board 300 as shown in FIGS. 4 and 5. Circuit board 300 is secured to the inside of the token sensor container 200 with fasteners (not shown). The fasteners may be mechanical, adhesive, or other fasteners. Circuit board 300 has a top side 305*a*, a bottom side 305*b* and an aperture 310 disposed through or passing through the center of the circuit board 300. A plurality of light sources 320 are provided to illuminate the token sensor assembly 130 from above. The filter 218 (shown in FIG. 2) provides a filtered, or softer light and is provided for visual effect.

Mounted on top side 305*a* are a plurality of chip-reading lights 330 and at least one memory chip (not shown). The LED's provide a source of light for the light receiver 340. Chip-reading lights 330 are preferably modulating infrared light emitters (such as light-emitting diodes, semiconductors, laser-emitting diodes, etc.). Receiver or sensor 340 is mounted to bottom side 305*b* directly beneath aperture 310.

As shown in FIG. 4, preferably at least three light sources (lights) 320 are disposed around aperture 310 at a predetermined distance 311 from aperture 310. Further disposed around the periphery of circuit board 300 are shown preferably six red light LEDs 320 for illuminating the token sensor assembly 130 from above and at least one memory chip (not shown) with memory logic. The light sources 320 are preferably distributed in equal spacing around the aperture and equidistant from the aperture, but asymmetrical spacing and varied differences from the aperture 310 may be used. It is preferred that multiple light sources be used in the event that dark chips are being sensed. Increasing the number of light sources 320 increases the probability that a light-colored area on the chip will be sensed. Light that hits the dark colored chips is absorbed and not reflected.

FIG. 5 shows a bottom plan view of a circuit board 300. The board has a bottom side 305*b* with a light receiver 340 mounted beneath aperture 310. Also disposed on the circuit board 300 bottom side 305*b* is at least one wiring connector 355*a*, 355*b*, preferably two connectors. These connectors, as previously described, may be engaged with the communication transmission wires (not shown) by snap-in, screw in, or mechanical clamping. Connectors 355*a*, 355*b* may be used to serially connect multiple sensors to the coin sensor controller 160 and/or the power supply (not shown).

In the operation of the wager recognition system, tokens (e.g., coins, tokens, casino gaming chips, plaques) are sensed by token sensor assemblies 130 receiving light reflected from the tokens. Signals from the sensors indicating reception of reflected light are detected by coin sensor controller 160 and further transmitted to game controller 170. Once game controller 170 receives the signal(s) from token sensor controller 160, game controller 170 associates the sensed token signal with a player position, such as player position number one, and optionally identifies the type of wager, i.e., base game wager, progressive wager, bonus wager, side bet wager, etc. The token can be a standard gaming chip, a coin which is official currency (such as a U.S. gold one dollar coin), or other item used in a casino that can be used to place a wager. The recognition of the type of wager and the player location may be accomplished by a look up table, an algorithm, an initialization program or the like. Each token sensor assembly 130 is electrically connected to token sensor controller 160 in series. The token sensor controller 160 may manage one or multiple strings of sensors connected in a series. Preferably, the token sensors controller 160 has at least two serial ports, each port capable of supporting up to thirty-two (32) serially connected token sensors. This number of token sensor ports allows up to four different wagers being reportable on a seven-player table and five different wagers being reportable on a six-player table. Token sensor controller 160 may send signals to the sensors and may receive signals from the sensors to enable each sensor to sense a new token, and can also place those sensors in "game over" mode in which token sensor assemblies 130 are ready to accept bets for a new round of play.

Once a chip, or token, is placed on token sensor assembly 130, light from chip-reading lights 330 is directed upwardly through the cover and is reflected off the token 265. The reflected light then passes through aperture 310 to receiver 340. A signal from the light receiver 340 is then sent to a memory logic gate, which is read by controller 160. Controller 160 then sends a signal to token sensor assembly 130 to turn on LEDs 320, which provides a visual indication of the placement of a wager at an appropriate time during play of a casino table game. Preferably, LEDs 320 may initially flash in a predetermined pattern until a dealer locks the bets via dealer input and display 150. The filter 218 may provide a soft light effect. Additionally, the dealer may "unlock" the ability to place wagers via the dealer input and display 150 to allow a player to add or remove a bet just prior to dealing cards. Upon locking the bets, LEDs 320 preferably remain lit in a continuous on mode until the end of the round. In this fashion, even if a token is removed from token sensor assembly 130 (which is often done to collect a non-refundable jackpot wager or some side bets), the sensor LEDs will remain illuminated. Since game controller 170 preferably receives hand information from a card handling device 180, once a win is determined, another signal from game controller 170 may cause token sensor assemblies 130 to blink in another predetermined pattern.

Token sensor assembly 130 has a plurality of light sources or chip-reading lights 330. Preferably the light sources are LEDs. Having a plurality of chip-reading lights 330 ensures that the light reflected off of a token does not hit a "black spot" on the token and cause a misread, i.e., a lack of reflected light causing the sensors to not sense a token when placed on the light transmitting and preferably removable translucent cover 190. Additionally, misreads (particularly in systems not incorporating the presently disclosed structure) may be caused by light reflecting within the sensor or ambient light triggering the receiver causing a sensor to indicate the presence of a token no chip is present. Therefore, an aspect of the present technology uses circuit board 300 as a partial barrier to prevent these types of misreads by directing only the reflected light from chip-reading lights 330 through aperture 310 to the receiver 340. Chip-reading lights 330 are placed a predetermined horizontal distance 311 from aperture 310 to reduce the chances of light reflecting from the inside of removable translucent cover 190 triggering receiver 340. Light bounces off chips 265 at an angle "A" (not shown) and travels through aperture 310. The distance (X) is a function of the properties of the light emitter and the distance between the sensed chip and the emitter (Y). By controlling or predetermining appropriate distances and angles by the use of geometry, the angle of incidence for light from the chip-reading lights 330 against a bottom surface of a token on the light transmitting translucent cover 190 creates an angle of reflection off of the token, which causes a significant portion of the reflected light to be directed at the aperture 310 and towards the receiver 340. This is particularly effective where the light emitted is focused from the chip-reading lights 330.

The token sensor controller 160 can perform four functions that impact the operation of token sensor assembly 130. Only one of these functions may be performed at a time. The token sensor controller 160 can read or change the state of the memory component on the token sensor assembly 130. The state of the memory component can be ON or OFF. The token sensor controller 160 can force the state of the memory component to be copied into the state of the RED LEDs 320. The token sensor controller 160 can also force the state of the receiver 340 into the memory component.

The token sensor controller 160 can read the state of the token sensor assemblies 130 by forcing all of the token sensor assemblies 130 to force the state of the receiver 340 on to each token sensor assembly 130 into the memory component at the same time. If there is a token 265 present at this time, the memory will be set to ON. Otherwise it is set to OFF. The token sensor controller 160 will then read all of the token sensor assemblies 130 by shifting the state of the memory component into the token sensor controller 160 one at a time.

The token sensor controller 160 can set the desired state of all of the token sensor assemblies 130. The desired state of each token sensor is shifted into the memory component of each token sensor assembly 130, one at a time. The token sensor controller 160 will force all of the states of each memory component of each token sensor assembly 130 to be copied into the state of the RED LEDs 320 at the same time. If the memory component is ON the RED LED will be (on); otherwise it will be (off).

Figure 6:
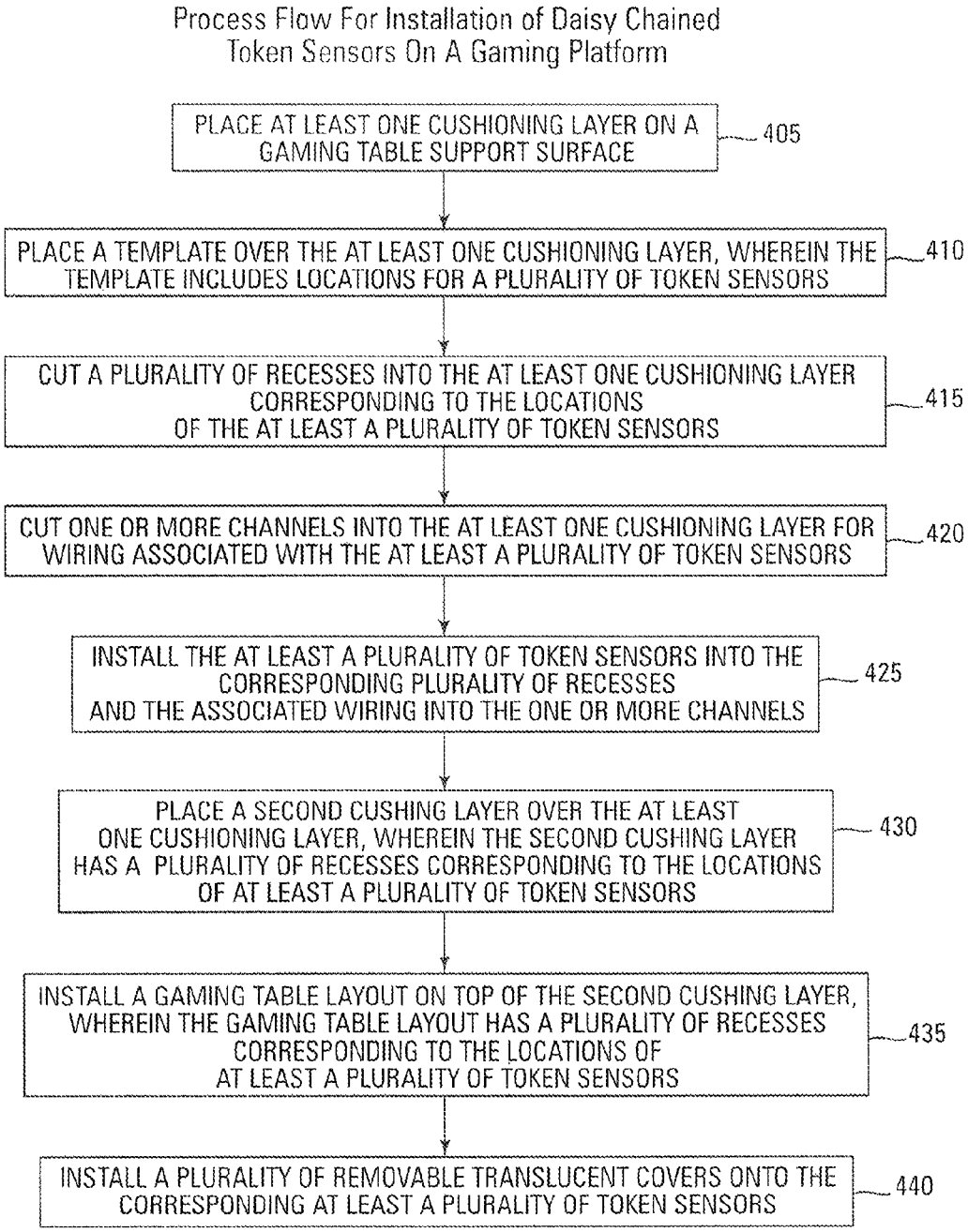
FIG. 6 is a process flow chart for an exemplary of method of installation of a gaming table apparatus with an integrated wagering system.

FIG. 6 is a process flow diagram for one method of fabrication of the table installed wager sensing system in the disclosed present technology. The method includes at step 405, placing at least one cushioning layer on a gaming table surface. Then at step 410, a template is placed on top of at least one cushioning layer 240. The template contains a plurality of identified locations for installing the plurality of token sensor assemblies 130. At step 415, the plurality of recesses 210 are shown to be cut into the at least one cushioning layer 240 corresponding to the locations of the plurality of token sensor assemblies 130. Preferably, a second cushioning layer 230 and felt gaming table surface 110 are cut at about the same time as the at least one cushioning layer 240. In that event, second cushioning layer 230 and felt 110 would be removed before proceeding to step 420. At step 420, one or more channels (not shown) are cut into the at least one cushioning layer 240 to accommodate sensor wiring 135. Preferably, the channel is cut in an inverted "V" shape and the cushioning material from the center of the channel is removed. In this manner, the top surface of the at least one cushioning layer 240 over one or more channels remains essentially intact leaving a slit through which sensor wiring 135 and grounding strap 260 may be pushed into the channel. Additionally, a grounding strap 260 may replace a traditional grounding plate that eases installation and reduces costs. In other embodiments, the channel is cut in the shape of a "V," "U," square or rectangle, and a second cushioned layer is positioned over the lower channeled layer to enclose the channel.

Once the plurality of recesses 210 and one or more channels (not shown) have been cut into first cushioning layer 240, at step 425 token sensor assemblies 130, sensor wiring 135 and grounding strap 260 may be installed in the respective openings or holes 210 and channels. After installing sensor wiring 135 and grounding strap 260 into the channel, at step 430 second cushioning layer 230 may then be installed. Alternatively, token sensor assemblies 130 may be installed after placing second cushioning layer 230 over the at least one cushioning layer 240. At step 435, gaming table surface or felt 110 is placed over second cushioning layer 230. Finally, at step 440, a plurality of removable translucent covers 190 are "snapped" onto the top end of the respective plurality of token sensor containers 200, thereby securing felt 110 around token sensor assemblies 130. In one embodiment, each token sensor assembly is fastened to the table support surface 215 by means of a fastener such as a screw, staple, nail, adhesive or the like. A conventional wood screw is a suitable device for attaching each assembly to the table. During fastening, it is important to position the grounding strap (not shown) under oppositely spaced notches 250*a*, 250*b* (shown in FIG. 3) so that each assembly is properly grounded to earth ground. The other wires may be fastened to the circuit board 300 at connectors 355*a*, 355*b* through apertures 252*a*, 252*b*.

Figure 7:
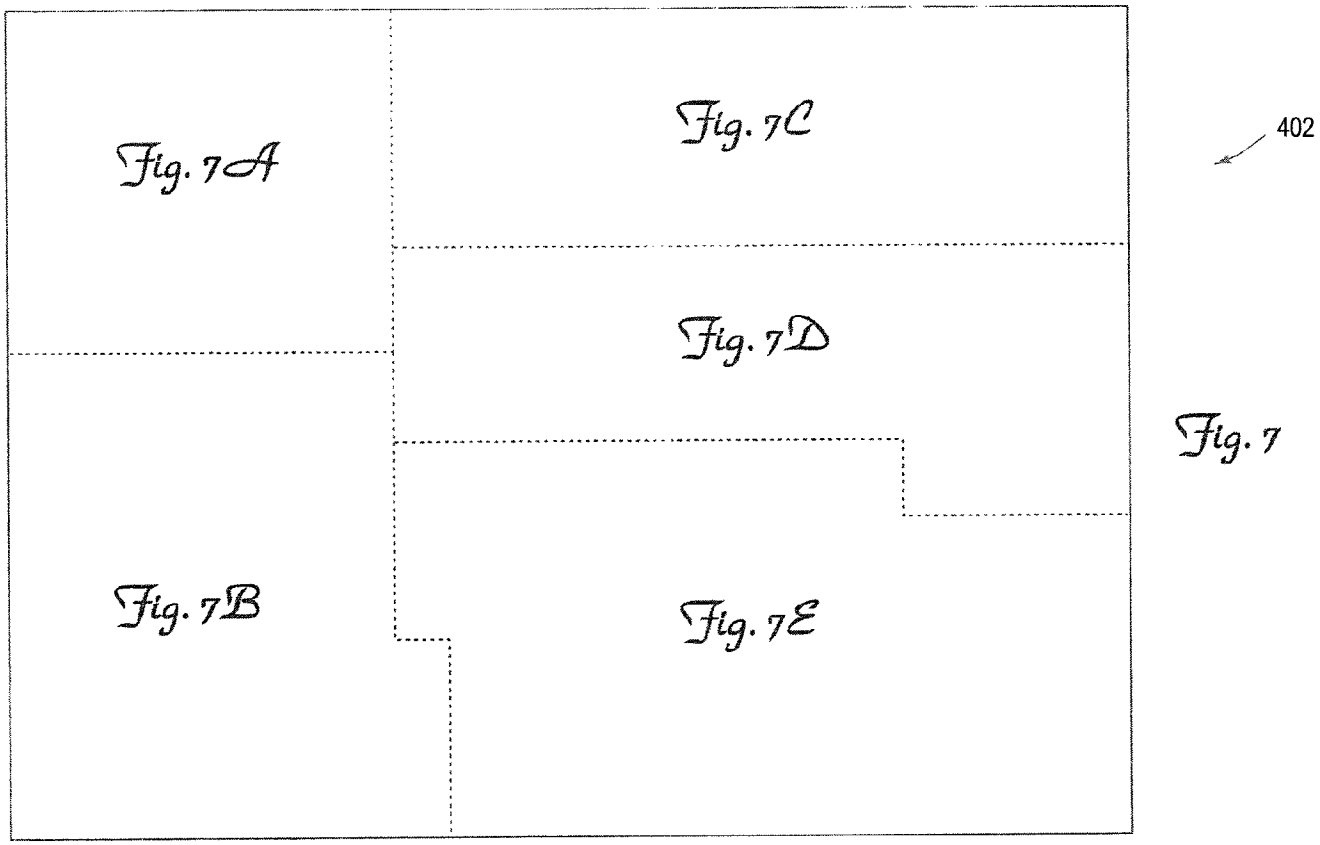
FIG. 7 is an electrical block diagram for schematic of an assembly of token sensor circuits having segments 7A, 7B, 7C, 7D and 7E in the assembly.
Figure 7A:
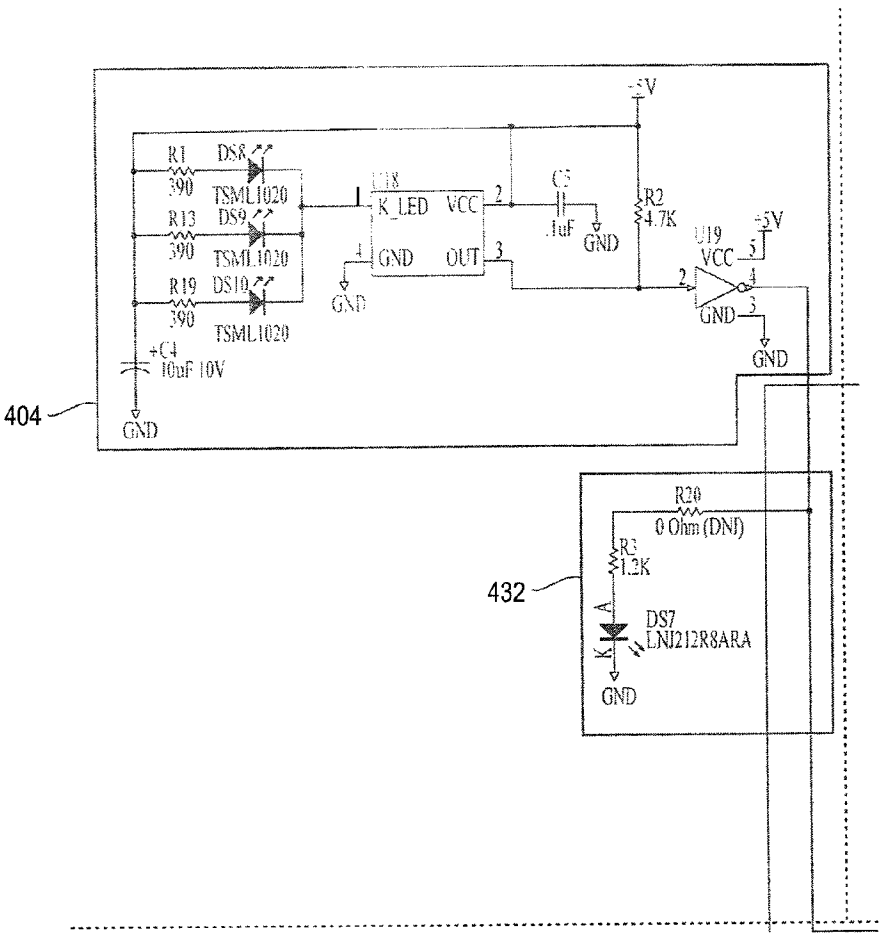
FIG. 7A is an electrical schematic of segment 7A from FIG. 7.
Figure 7B:
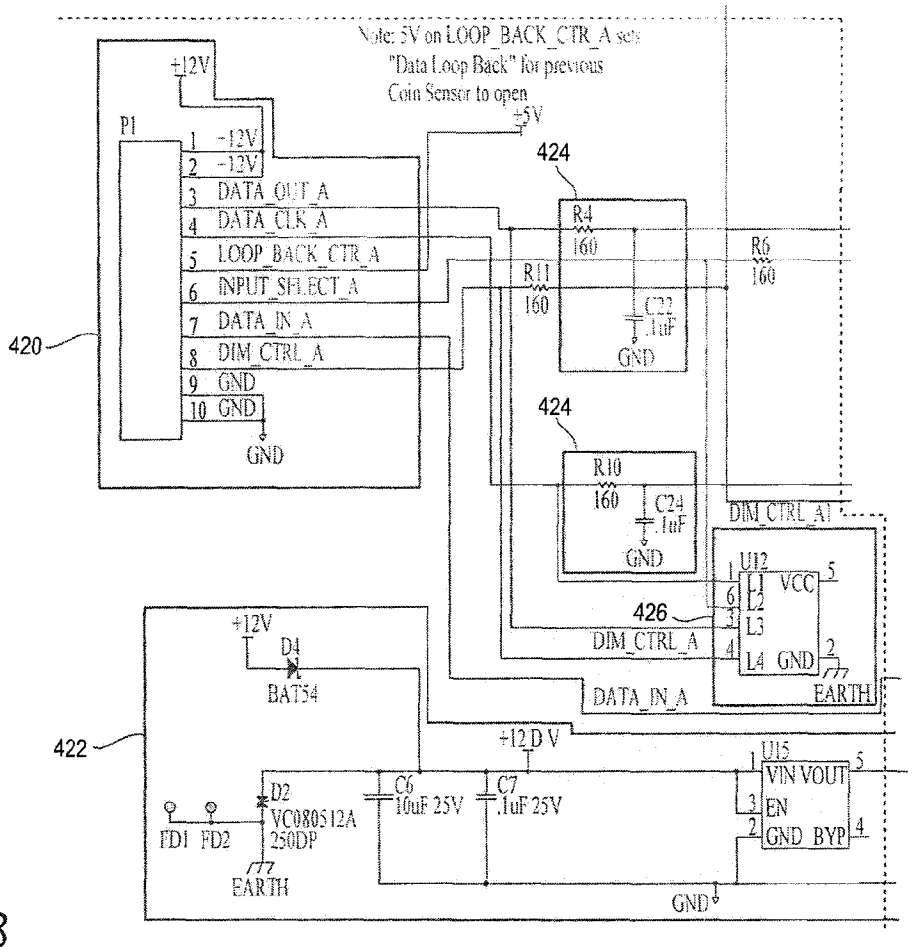
FIG. 7B is an electrical schematic of segment 7B from FIG. 7.
Figure 7C:
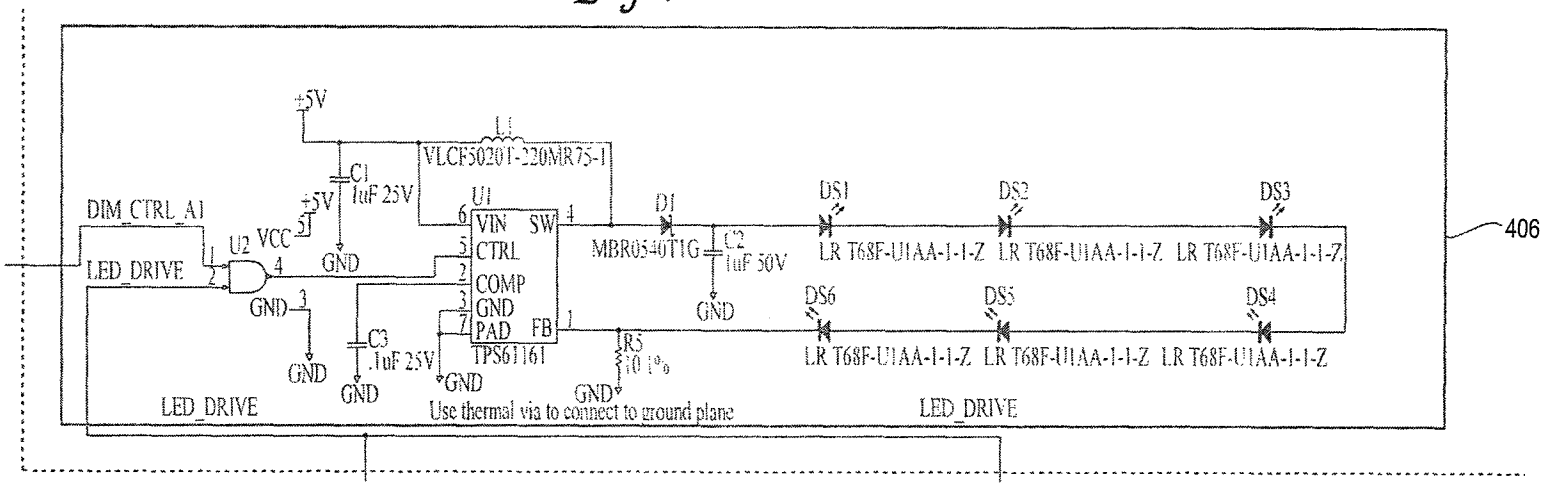
FIG. 7C is an electrical schematic of segment 7C from FIG. 7.
Figure 7D:
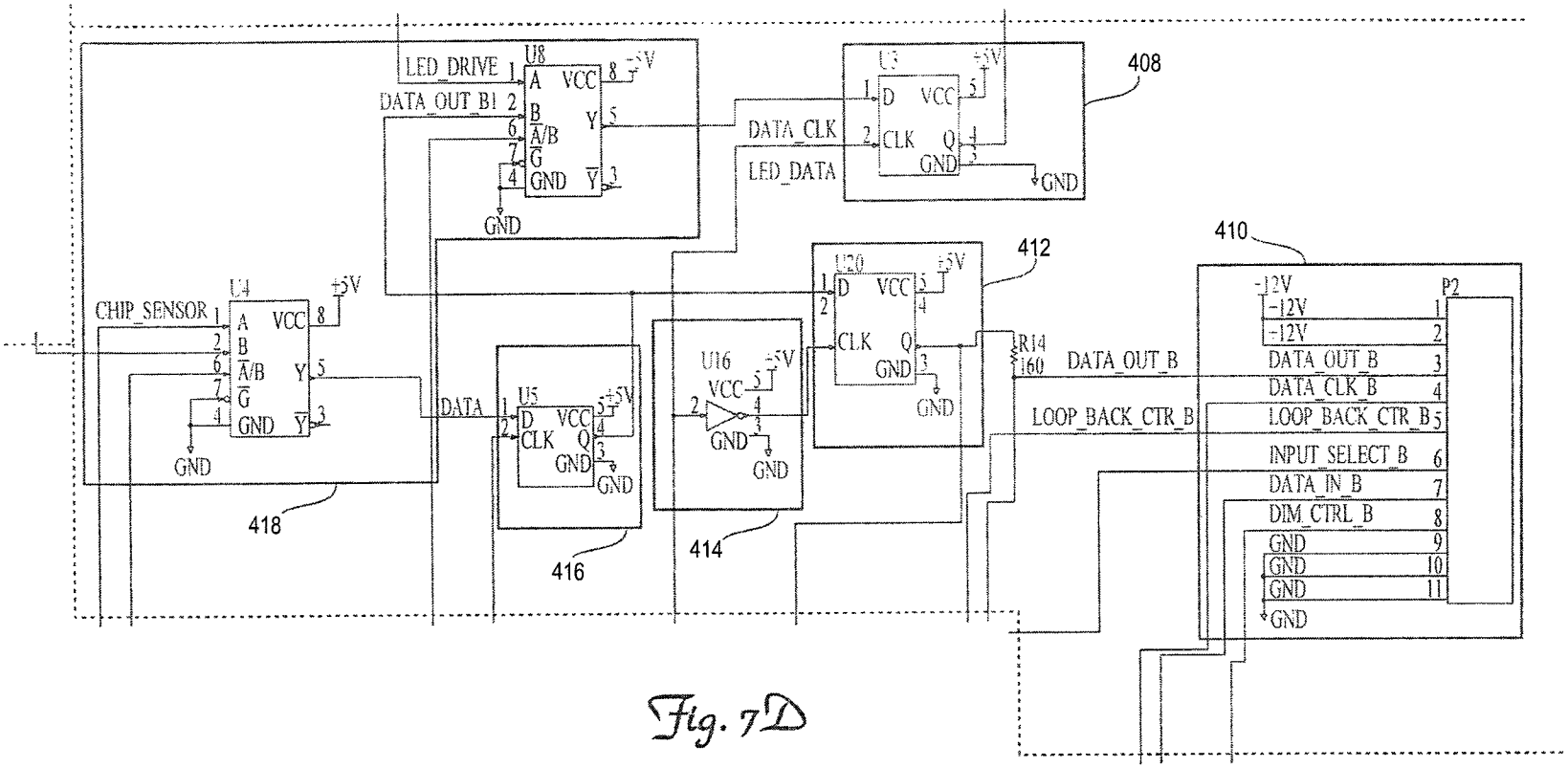
FIG. 7D is an electrical schematic of segment 7D from FIG. 7.
Figure 7E:
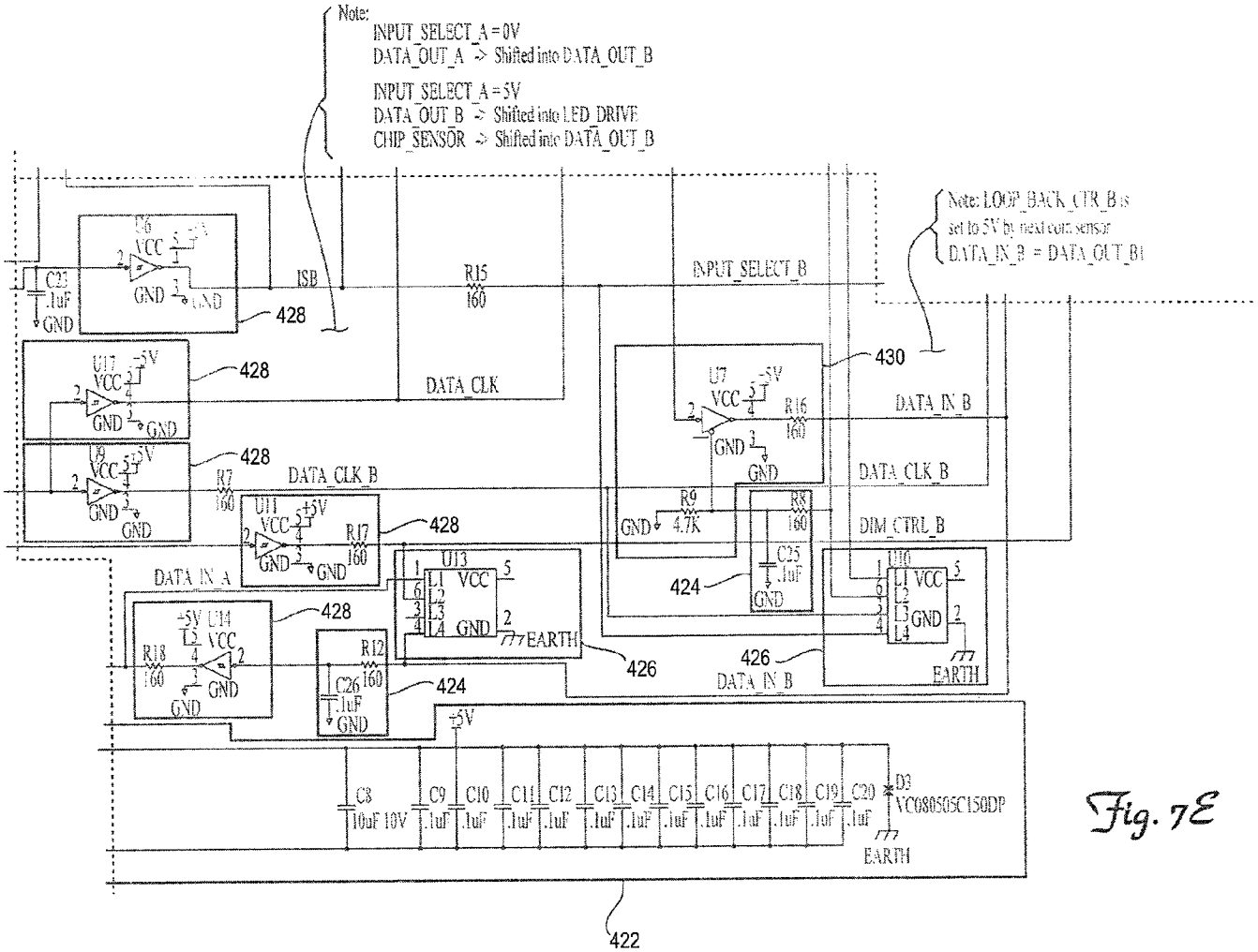
FIG. 7E is an electrical schematic of segment 7E from FIG. 7.

FIG. 7 is an electrical schematic for an individual coin spot circuit. Flip_flop circuits that utilize a common clock signal for a shift register are well known in the art of electronics. The electrical components of the coin sensing circuit include three parts. These are a coin sensor 404, a one-bit memory unit 416 and the output light or emitter. The coin sensor internally emits and receives and identifies the light radiation that is reflected off of tokens, coins or chips.

In one example, if the token is present the coin sensor system will emit and be sensitive to reception of visible red light, somewhere between 680 nm and 750 nm. If the coin is not present, the coin sensor system will still emit red sensing radiation, but insufficient amount would be reflected back towards the sensor, and the system will register an absence of a wager and will determine that no token is present. As the light emitted by the emitter is red, the light transmitting cover would transmit radiation in the wavelength(s) to which the light receiver is most sensitive, again in the red region of the electromagnetic spectrum.

FIG. 7 shows the schematic of the electronic circuitry of an individual token sensor 402, with the schematic being shown in sections in FIGS. 7A-7E. Major components include: a sensor sub-circuit 404, a lamp controller circuit 406, lamp output controller 408, circuitry 410 to transmit signals (or not) to an adjacent token sensor through a serial connection, inversion memory 412, an inverter 414, system memory 416, mode controller 418, input from adjacent token sensor 420, power input circuit 422, time-constant resistor capacitors 424 (this flattens spike output from the surge suppressor in the event of a power surge), surge suppressor 426. The use of surge suppressors in combination with resistor capacitor avoids the use of a cumbersome ground plate for suppression of power spikes up to 26 kV, for example. The surge suppressor is connected to the Earth ground wire through a grounding strap (which is electrically connected to the third prong of the electrical power plug), drivers 428, and general connecting wires. The grounding strap may be the same grounding strap that is used to ground each token sensor assembly, or may be another grounding strap.

The mode controller 420 can perform a number of operations on the coin sensors (token sensors). The mode controller 420 can cause a cycle to begin of sensing, turning lights on and off, and restarting a new cycle of token sensing with the initiation of a new round of play of the game. The mode controller 420 may also provide a simple clock pulse that is connected to one of the wires and, for the simplest example, this clock pulse is the same for each of the sensors because of the manner in which the sensors are wired together. Another function of the mode controller 420 is change the mode of the sensors. All of the coin spots are simultaneously in the same Mode because they are wired together serially. The mode of each sensor changes together at different stages of the game, from an unlit to lit condition, and then back again.

The token sensor assemblies 130 basically have two different operational modes.

Mode 1 is the Read/Write Mode.

In Mode 1, the sensor reads data stored in memory and that data in memory directs the operation of the light for each cycle.

Mode 2 is the Shift Mode.

The mode controller transfers the desired state of the lights to the memory by outputting the desired state of the lights, one at a time, to each of the token sensors. If there are three token sensors, the controller may use three cycles to transfer the desired state to the first token sensor connected to the controller. During each cycle, the desired state is shifted to the next serially connected token sensor. This mode is also used to read the memory in each token sensor. It takes two cycles to read the memory of the three token sensors.

In Mode 2 and during each cycle, data is shifted from the memory of the controller, then to the adjacent coin spot, and then to another adjacent coin spot and so on until all sensor memories are loaded with the data.

This mode is used to transfer the actual state of the token sensor to the memory. The state that was in the memory at the start of the cycle is also used to light the token sensor. The new token sensor state is stored in memory at the same time the current state of the memory is used to control the light in the token sensor.

Before the first cycle, the controller can read the memory of the third token sensor, which is the sensor directly connected to the controller. After the first cycle, the state of each sensor is transferred to the next coin spot. After the first cycle, the state of the memory in the second token sensor is transferred to the third token sensor. After the first cycle, the state of the memory in the first token sensor is transferred to the second token sensor. Before the second cycle the state of the second token sensor is read by the controller because the third token sensor memory now holds the information that was in the second token sensor. After the second cycle the state of the memory in the second token sensor is transferred to the third token sensor. After the second cycle the state of the memory in the first token sensor is transferred to the second token sensor. Now the third token sensor memory contains the information from the first token sensor. Now the controller can read the information that was in the first token sensor because it has been transferred to the third token sensor by the controller giving the token sensors two cycles. The controller can read a different number of token sensors in a similar manner.

The controller also uses Mode 2 to determine the number of sensors by transferring digital data patterns into the first token sensor and reading the memory of the final token sensor. There is a switch built into each sensor that allows the last token sensor to either connect the memory in the token sensor to the next token sensor or return it to the controller. This switch is activated if the last token sensor does not have anything connected to it. This allows each token sensor to be connected to the next using the same wire cable.

Among benefits of the serial arrangement are:

1. Simple wiring;
2. Allows for simple surge protection to be able to easily pass a 27 KV shock test;
3. Simple low cost circuit;
4. Each token sensor is the same and can be readily replaced without interfering with the ability of operating coin sensors to continue working during play of games;
5. Each token sensor position is determined by its location in the serial string;
6. Ease of initial installation;
7. Allows for simple grounding of all token sensors that only requires a ground strap to follow the serial string;
8. The simple circuit allows for a simple low profile housing that makes installation simple; and
9. Allows for easily changing the number of token sensors to be changed by simply adding more in the string.

Example 1

The token sensor reads a coin at the start of the cycle. No data is found in memory. That information is transferred to the light. The light remains off. After the cycle, the sensor reads the token and that information is copied into the memory. This puts information into memory that a token is present and the light is turned on in an appropriate mode (e.g., flashing before lock-out of bets, and continuously after lock-out of bets).

Example 2

Assuming that the first and last token sensors are serially connected to the controller, the following conditions exist:

Before the cycle, the second token sensor memory contains something and the first and third coin spots memory contain no data. After the cycle, the information from the controller is transferred to the first token sensor. The information from the first token sensor is transferred to the second token sensor. The information from the second token sensor is transferred to the third token sensor. The information from the third token sensor is transferred to the controller.

It takes three cycles to transfer new data into the three token sensors. It takes the two cycles to transfer the data that was in the token sensors to the controller.

To read three coin sensors and set the lights, the following steps are used.

Step 1

The controller sets the coin spots in Mode 2 and in three cycles the state of the desired lights is transferred to the memory in the coin spots.

Step 2

After the three cycles that transferred the desired state of the lights into the memory of each coin spot the mode of the coin spots is changed to Mode 2.

Step 3

In one cycle, the information read by the coin sensor is transferred to the memory and the information in the memory is used to energize the light.

Step 4

The coin spots are changed to Mode 1.

In two cycles the information is transferred from the coin spot's memory to the controller.

Returning to FIG. 8, the major sub-circuits (circuit board 300) are as follows:

Sensor sub-circuit 404—This circuit determines whether a chip is placed on the sensor based on the presence or absence of a light input.

Lamp controller circuit 406—This circuit controls the LEDs on the coin spot. It turns the lights on or off and changes brightness.

Power indicator light 432—This sub-circuit indicates whether the circuit has power. This can be turned off or on when necessary for testing.

Lamp output controller 408—This sub-circuit determines whether to turn off or on the LEDs on the coin spot.

Mode controllers 418—This is a card roller that controls modes one or two.

System memory 416—This is a one bit memory chip.

Inverter 414—This sub-circuit changes an 0 to a 1 and vice versa.

Inversion memory 412—This component determines the reverse of the data in memory. If memory is a 0, then inversion memory is a 1.

Driver(s) 428—This circuit comprises drivers.

Surge suppressor 426—This circuit is a surge suppression circuit. In combination with resistor capacitors 424, this circuit aids in avoiding the use of cumbersome ground plate for suppression of voltage (26 kV) i.e., spikes. The surge suppressor 426 is connected to earth ground through a grounding strap, which is electrically connected to the third prong of the electrical power plug.

Resistor capacitor 424—This is a resistor-capacitor time-constant circuit. Its function is to flatten spike output from surge suppressor in the event of a power surge.

Loopback switch 430—This sub-circuit switches when the coin spot is the last coin spot in the chain.

Power input circuit 422—This circuit provides power to the coin spot.

The connectors (input and output) are either connected to another coin spot or not connected at all.

Code for communication on lines:

At "Input" to controller 420:

Dim ctrl A—controls the brightness of the coin spot lights.

Data in A—The feedback to the controller.

Input select A—Selection of mode 1 or 2 is on this line.

Loopback switch 430: Ctrl A—Is 5 V because the coin spot before in serial connection is not the last coin spot.

Data clock A—250 HZ clock signal. This signal is sent from the controller and the frequency is not changed by the coin spot circuit.

Data out A—The output of the previous coin spot or the controller.

At "Output" from lamp output controller 410:

Data out B—the output of the coin spot. If the coin spot is connected to another coin spot from the output, then this line will become data out A on the next coin spot.

Data clock B—250 HZ clock signal. If the coin spot is connected to another coin spot from the output, then this line will become data clock A on the next coin spot.

Loopback switch 430:

Ctrl B—If the coin spot is connected to another coin spot then the line will be at 5 V (binary 1). If not, then the line will be at 0 V (binary 0) and the controller will know that this coin spot is the last coin spot which is connected.

Input select B—The selection of mode 1 or 2. If the coin spot is connected to another coin spot then the line input select B will become input select A in the next coin spot.

Data in B—Feedback to the controller. Connected if loopback switch is closed, which occurs if loopback ctrl B is at 0 V.

Dim ctrl B—controls the brightness of the coin spot lights. If the coin spot is connected to another coin spot then the line dim ctrl B will become dim ctrl A in the next coin spot.

Note: There are various lines in FIG. 7 labeled "gnd," which is an abbreviation for ground and 12 V, which is an abbreviation for 12 volts.

Figure 8:
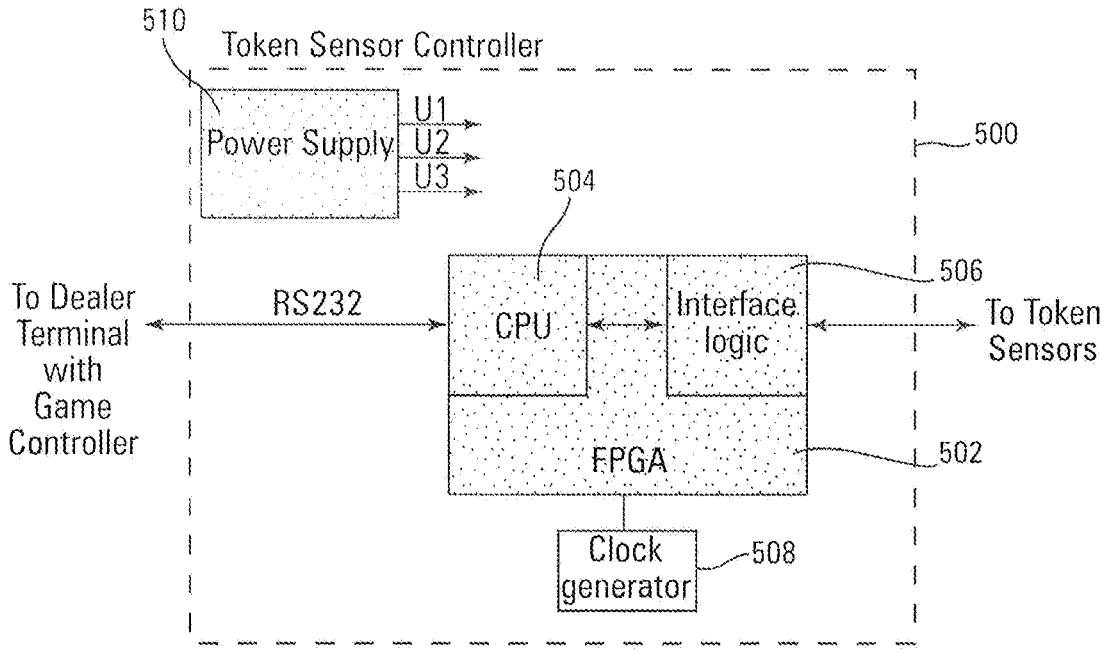
FIG. 8 is a block diagram of an exemplary token sensor controller.

Token sensor controller—FIG. 8 is a diagram of a token sensor controller 500. An FPGA 502 contains the following major components: a CPU 504, interface logic 506 and associated wiring or contacts to connect with other components operatively connected to the FPGA 502. The CPU 504 is a central processing unit that carries out each instruction of a computer program in sequence, to perform the basic arithmetical, logical, and input/output operations of the FPGA 502. The interface logic 506 is a circuit with logic gates to transfer information between the token sensor assemblies 130 and the CPU 504. The clock generator 508 is operatively connected to the FPGA 502. A clock generator 508 is a circuit that produces a timing signal (known as a clock signal and behaves as such) for use in synchronizing the operation of the coin sensors (the data clock A line described above). The signal is generally a simple symmetrical square wave. A power supply 510 provides power to the token sensor controller 500. The connection between the FPGA 502 and the dealer input and display 150 uses an RS 232 standard for serial port communication with a custom computer protocol.

The token sensor controller 500 is connected to the game controller 170. The game controller 170 is a small personal computer that contains a dealer processor which has a small single board computer and an I/O board with sensor controller and door switch. An example of a single board computer which could be used is an IB883 family board from iBase Technology, Inc. The sensor controller 500 drives two mechanical meters as well. The dealer input and display 150 has a capacitive touch screen display, which is made by Zytronic PLC. The game controller 170 is connected to a dual monitor panel (not shown) which is used to display the progressive values and other information regarding the game being played at the table. An example of such monitors would be two EFL 1903X from Effinet Systems, Inc., packaged as model number EFL 1903XD.

Each table's game controller 170 is connected to a computer server via Ethernet directly or via a serial link with an adapter to allow for Ethernet communication. The server runs a MICROSOFT® WINDOWS 2000® operating system or later version of an operating system based software program which has the following desirable functions (amongst other functions):

1. A user interface to configure the progressive games on the link which includes the game type (i.e., CARIBBEAN STUD® poker, THREE CARD POKER PROGRESSIVE® game or PROGRESSIVE TEXAS HOLD 'EM® game) to be selected with pay table options along with the progressive meter start value, the amount incremented to the progressive meter from each wager, the reserve amount from each wager and the casino profit from each wager.
2. A tool to configure communication ports.
3. A tool monitor for progressive jackpot activity on the serial links.
4. A computer to generate reports on the system, user, wins (including W2G tax farms) and other useful table game information.

An example of such a software program is the GAME MANAGER™ software sold by Shuffle Master, Inc.

When a top award in a pay table is won by a player (such as by a player attaining a royal flush in CARIBBEAN STUD® poker) and the player's coin spot or token sensor is lit, the dealer (and casino supervisory personnel as well) enter that information on the touch screen input at the dealer input and display 150. The player's cards are visually compared to the required top award by the appropriate casino personnel. The player's hand can also be verified by an I-DEAL® shuffler sold by Shuffler Master, Inc. This shuffler is described in detail in U.S. Patent Publication US2008/0303210. The content of this application is incorporated by reference. The I-DEAL® shuffler can also provide an input into the game controller of a top award win or a lower jackpot or bonus win. The game controller communicates the top award win to the server. The server then resets all of the progressive meters on the link to a start value or to a reduced value when a lower award was made that was taken from the progressive jackpot amount. The progressive jackpot amount increments until a player wins and either causes the meter to reset to a start value (usually a top award win like a royal flush in CARIBBEAN STUD®) or the progressive amount is reduced by certain wins (i.e., 10% of the meter would be paid if a player received a straight flush in CARIBBEAN STUD®), which are paid out of the progressive jackpot amount.

Sensing systems useful in the practice of the present invention may be installed in the field, without the need to modify the underlying table structure. The improved sensing system all but eliminates misreads due to dark chip color, and provides a less expensive sensing system, reducing the cost of the leased equipment to the company. Additional coin sensors can be added to the tables, and installation of such a system is rapid and simpler than with known systems.

Although specific ranges, specific compositions, and specific components have been identified to enable preferred practice of the present technology, one skilled in the art, reading the specification and viewing the figures, understands the generic concepts disclosed herein. This understanding enables the use of alternatives and options and design changes within the skill of the ordinary artisan in the electronics and imaging field, without undue experimentation and within the scope of the claims.

What is claimed:

1. A gaming table wager sensing apparatus, comprising:

a token sensor controller;

a plurality of token sensor assemblies electrically connected in series to the token sensor controller, wherein the plurality of token sensor assemblies are positionable on a gaming table support surface for physical restraint in a flexible layer above the gaming table support surface, and wherein each token sensor assembly of the plurality of token sensor assemblies comprises:

a sensor memory component configured to store a state of the token sensor assembly; and a sensor mode controller configured to transfer the state of the token sensor assembly to the sensor memory component of a next token sensor assembly of the plurality of token sensor assemblies; and a game controller in communication with the token sensor controller, wherein the game controller is configured to associate player position data with transmitted wager data received from the token sensor controller.

2. The gaming table wager sensing apparatus of claim 1, wherein each token sensor assembly of the plurality of token sensor assemblies comprises a circuit board that does not execute software with any component thereon.

3. The gaming table wager sensing apparatus of claim 1, further comprising the gaming table support surface and the flexible layer physically restraining the plurality of token sensor assemblies, wherein the flexible layer includes electrical wires providing a serial data communication link between the plurality of token sensor assemblies and the token sensor controller.

4. The gaming table wager sensing apparatus of claim 3, wherein the flexible material is selected from the group consisting of felt, elastomeric polymer, polymeric foam, and combinations thereof.

5. The gaming table wager sensing apparatus of claim 3, wherein each token sensor assembly of the plurality of token sensor assemblies comprises:

a module configured to communicate with the serial data communication link;

a first contact that engages the serial data communication link; and a second contact that engages a power source.

6. The gaming table wager sensing apparatus of claim 1, wherein at least one token sensor assembly of the plurality of token sensor assemblies comprises:

a container having a height and side walls which define an inside and outside perimeter of the container, and a top surface and bottom surface of the container;

a translucent cover disposed on the top surface of the side walls;

a circuit board having a top side, a bottom side and an aperture disposed through both the top side and bottom side, wherein the circuit board is secured to the inside perimeter of the container;

a plurality of light sources disposed on the top side of the circuit board above the aperture; and at least one light sensor disposed on the bottom side of the circuit board beneath the aperture, wherein the plurality of light sources are positioned and configured to generate light that is reflected off of a token if the token is positioned on the translucent cover such that the reflected light is sensed by the at least one light sensor.

7. The gaming table wager sensing apparatus of claim 6, wherein the translucent cover is removable from the top surface of the side walls.

8. The gaming table wager sensing apparatus of claim 6, wherein the plurality of light sources are located at a selected distance from the aperture such that the light is transmitted through the translucent cover, reflected off of the token placed on the translucent cover, and the reflected light transmitted back through the translucent cover passes through the aperture and is sensed by the at least one light sensor.

9. The gaming table wager sensing apparatus of claim 6, further comprising:

a power source; and a grounding strap coupled with an earth ground connection on the power source, wherein the side walls include at least two notches that are configured to engage the grounding strap.

10. The gaming table wager sensing apparatus of claim 6, further comprising:

a power source external to the at least one token sensor assembly, wherein power and data are transmitted through wires extending through the at least one aperture extending through at least one side wall, wherein the wires are in communication with the circuit board.

11. The gaming table wager sensing apparatus of claim 1, wherein the sensor mode controller for each token sensor assembly is configured to operate the associated token sensor assembly according to a plurality of different modes.

12. The gaming table wager sensing apparatus of claim 11, wherein each token sensor assembly of the plurality of token sensor assemblies further includes at least one light source.

13. The gaming table wager sensing apparatus of claim 12, wherein a mode of the sensor mode controller includes a read/write mode in which the sensor mode controller is configured to direct operation of the at least one light source based on data read in the sensor memory component of the individual token sensor assembly.

14. An apparatus for sensing tokens, comprising:

a token sensor controller; and a plurality of token sensor assemblies connected with the token sensor controller as a serial string of token sensor assemblies, wherein the plurality of token sensor assemblies and the token sensor controller are configured to communicate data therebetween through the serial string of token sensor assemblies, the data indicating a presence of a token placed as a wager for a wagering game, wherein each token sensor assembly of the plurality of token sensor assemblies includes:

a sensor memory component configured to store the data; and a sensor mode controller configured to transfer the data to the sensor memory component of a next token sensor assembly of the plurality of token sensor assemblies.

15. The apparatus of claim 14, wherein each token sensor assembly of the plurality of token sensor assemblies comprises a circuit board having at least one connection that is configured to receive at least one of data and power therethrough.

16. The apparatus of claim 15, wherein the at least one connection includes at least one connection for the data and at least one separate connection for the power.

17. The apparatus of claim 16, wherein the at least one connection includes a quick-connect connection.

18. The apparatus of claim 14, further comprising a game controller configured to associate the player position data with the transmitted wager data based, at least in part, on a location of each token sensor assembly of the plurality of token sensor assemblies.

19. The apparatus of claim 14, further comprising another plurality of token sensor assemblies connected with the token sensor controller as another serial string of token sensor assemblies, wherein the serial string of token sensor assemblies is coupled to a first port of the token sensor controller, and the another serial string of token sensor assemblies is coupled to a second port of the token sensor controller, wherein the token sensor controller is configured to manage the serial string of token sensor assemblies and the another serial string of token sensor assemblies.

20. The apparatus of claim 14, wherein the sensor memory component is a one-bit memory component.

21. The apparatus of claim 20, wherein the token sensor controller is configured to read the data from each of the token sensor assemblies and responsively turn on at least one light providing a visual indication of a placement of the wager at a corresponding token sensor assembly.

22. The apparatus of claim 20, wherein the token sensor controller is configured to read or change a state of the sensor memory component of each token sensor assembly of the plurality of token sensor assemblies.

23. The apparatus of claim 20, wherein the token sensor controller is configured to read the sensor memory component of each token sensor assembly by shifting the state on the sensor memory component of each token sensor assembly into the token sensor controller one at a time.

24. The apparatus of claim 20, wherein the token sensor controller is configured to set a desired state for each token sensor assembly of the token sensor assemblies by shifting the desired state to the sensor memory component of each token sensor assembly one at a time.

25. The apparatus of claim 20, wherein the one-bit memory component is a flip flop.

* * * * *